United States Patent [19]

Martin et al.

[11] 3,993,082

[45] Nov. 23, 1976

[54] TOBACCO SUBSTITUTE

[75] Inventors: R. Hugo Martin; William F. Owens, Jr., both of Pisgah Forest; Stuart W. McCarty, Brevard, all of N.C.

[73] Assignee: Olin Corporation, Pisgah Forest, N.C.

[22] Filed: May 5, 1975

[21] Appl. No.: 574,313

Related U.S. Application Data

[63] Continuation of Ser. No. 395,643, Sept. 10, 1973, abandoned.

[52] U.S. Cl. ..... 131/2; 131/17 R

[51] Int. Cl.[2] ..... A24B 15/02

[58] Field of Search ..... 131/2, 17, 140 C, 140 P

[56] References Cited

UNITED STATES PATENTS

| | | | |
|---|---|---|---|
| 3,100,492 | 8/1963 | Schmidt | 131/2 |
| 3,608,560 | 9/1971 | Briskin et al. | 131/2 |

FOREIGN PATENTS OR APPLICATIONS

| | | | |
|---|---|---|---|
| 687,507 | 3/1967 | Belgium | 131/2 |

*Primary Examiner*—Robert W. Michell
*Assistant Examiner*—V. Millin
*Attorney, Agent, or Firm*—Robert W. Habel

[57] ABSTRACT

A paper tobacco substitute which produces a neutral taste when blended with tobacco, comprising cellulose fibers and a filler, said filler comprising at least 55% by weight finely pulverized carbon particles based on the weight of the cellulose. In addition to carbon, the filler may include an alkaline earth metal carbonate or oxide such as calcium carbonate or magnesium oxide to further enhance the properties of the paper as a tobacco substitute. The carbon filled paper may be cut or shredded to simulate natural tobacco and can be used as a blend with tobacco in smoking articles.

13 Claims, No Drawings

TOBACCO SUBSTITUTE

This application is a continuation of copending Application Ser. No. 395,643, filed Sept. 10, 1973 now abandoned.

BACKGROUND OF THE INVENTION

This invention relates generally to tobacco substitutes and more particularly to tobacco substitutes comprising cellulose.

It is known that cellulose and certain derivatives thereof can be used as tobacco substitutes to replace part or in some cases all of the tobacco in a smoking article. Cellulose, itself, is one of the main constituents of a cigarette being present to the extent of 15% to 20% by weight. Most of the cellulose is present in the tobacco, the leaf containing 5% to 11% and stems or midribs as high as 25% although the paper wrapper contributes as much as 3% of the total cellulose content.

While the cellulose in the stems sometimes causes an off taste in the smoke, the relatively small amount of cellulose in the tobacco itself is generally masked and does not produce unfavorable tastes or odors. However, it has been found that when additional cellulose is blended with tobacco, for example, by shredding conventional paper made from pulped cellulose fibers and mixing it with tobacco in a smoking article, the resulting smoke from the mixture is harsh and unpleasant, even with as little as 2% added cellulose. This would be expected in view of the acrid and harsh odors generally noticeable in smoke obtained from burning paper.

Various attempts have been made to develop cellulose tobacco substitutes that would overcome this problem by modifying the cellulose in some manner. For example, U.S. Pat. No. 3,638,660 discloses a method for producing a tobacco substitute by highly beating fibrous wood pulp containing at least 90% alpha cellulose, intimately combining the beaten pulp with certain combustion modifiers and thereafter forming a sheet therefrom which can be cut and blended with tobacco for use in smoking articles.

An example of a tobacco substitute employing a derivative of cellulose is disclosed in U.S. Pat. No. 3,461,879 wherein cellulose oxidized to eliminate compounds giving undesirable taste to the smoke is impregnated with minor amounts of a hydrated metal compound. A variation of this product is disclosed in U.S. Pat. No. 3,608,560 wherein oxidized cellulose is mixed with combustible carbon in an amount within the range of 2% to 50% by weight of the oxidized cellulose material to form a tobacco substitute.

While all of these tobacco substitutes are better than plain paper, they have the disadvantage of being expensive to produce while still leaving much to be desired insofar as approximating or duplicating the organoleptic effect obtained from tobacco smoke. Moreover, when blended with tobacco in a smoking article, the reduction in overall undesirable elements in the smoke may also not be as effective as desired.

SUMMARY OF THE INVENTION

Accordingly, it is an objective of this invention to provide an improved and inexpensive paper tobacco substitute which employs essentially untreated cellulose fiber.

Another object of this invention is to provide a paper tobacco substitute made in part from cellulose fiber which when mixed with tobacco and burned does not produce the acrid and harsh odors normally associated with burning paper.

Still another object of this invention is to provide a paper tobacco substitute comprising cellulose fiber which when blended with tobacco in smoking articles reduces the undesirable components found in tobacco smoke.

A specific object of this invention is to provide a tobacco substitute comprising a paper made from essentially untreated pulped cellulose fibers and a filler which can be combined with tobacco and smoked to produce an organoleptic effect equivalent to the tobacco by itself.

Surprisingly, we have found that paper made from a combination of pulped organic cellulose fiber and a filler of finely pulverized carbon, wherein the paper contains at least 55% by weight carbon filler based on the weight of the cellulose fiber, can be used as an inexpensive tobacco substitute that when burned produces smoke that closely approximates the organoleptic effect of tobacco smoke without any of the harshness normally associated with the addition of cellulose in smoking articles. Any conventional cellulose fiber can be used, such as pulped flax fiber, high alpha cellulose wood pulp, or cellulose fiber derived from cotton and other organic plants, and no alteration in its natural characteristics is required other than normally occurs during conventional paper making. Flax fiber is especially preferred.

The invention resides in the discovery that where the cellulose fiber paper contains at least 55% carbon filler based on the weight of the cellulose fiber, the paper when burned produces smoke that has a balanced acrolein/tar ratio substantially equivalent to tobacco. Acrolein, which is produced by the combustion of cellulose, is generally recognized by the tobacco industry as a good measure of vapor phase yield and a major cigarette smoke taste component. When the acrolein/tar ratio is balanced as in the case with the smoke from natural tobacco having an acrolein/tar ratio of approximately $3 \times 10^{-3}$, a pleasant organoleptic effect is obtained. When it is unbalanced, particularly upwardly, a harsh taste results such as that obtained in the smoke from plain cellulose paper which has an acrolein/tar ratio of approximately $5 \times 10^{-3}$. Unexpectedly, we have found that paper containing a blend of cellulose fiber and carbon filler in which the carbon filler is present in amounts greater than 55% based on the weight of the fiber achieves the desired balanced acrolein/tar ratio whereas paper containing less than 55% carbon filler based on the weight of cellulose fiber produces smoke with an upwardly unbalanced acrolein/tar ratio and is thus harsh and acrid.

The carbon filler may be either activated or unactivated and is usually pulverized sufficiently to pass through an 80 mesh screen or smaller. Typical carbons that may be used are finely pulverized wood carbons, mill waste carbons, low sulfur petroleum base carbons, and activated nut shell charcoal.

A particularly preferred paper for use as a tobacco substitute can be obtained if the total filler comprises a mixture of pulverized carbon and inert material such as an alkaline earth metal carbonate or oxide. Specific examples are calcium carbonate, magnesium carbonate, magnesium oxide or calcium oxide. Calcium carbonate is particularly preferred. With this combination the amount of carbon in the filler can be held to 55% by weight of the fiber while maintaining the total filler level high. Surprisingly, this combination enhances and improves the organoleptic effect in the smoke of the paper when burned. Percentages of carbon filler used based on the weight of the cellulose fiber thus can be as low as 55% and as high as 400% with the balance of the filler, if additional is necessary, being an alkaline earth metal carbonate or oxide. Preferably, the amount of carbon used ranges from 55% to 250% by weight based on the weight of the cellulose fiber.

The tobacco substitute of this invention may be made using any conventional paper making techniques. Flavorants, burning chemicals and colorants may be added to the furnish prior to web formation, if desired, or they can be sprayed on the paper at later stages in the process. After the paper is made, it can be cut or shredded to simulate natural tobacco and blended with tobacco in any desired amount depending upon the effect desired in the smoking article such as cigarettes and the like.

PREFERRED EMBODIMENTS

The results obtained in accordance with this invention are described in the following illustative examples.

EXAMPLE I

Paper containing 30% by weight high alpha cellulose flax fiber and 233% by weight finely pulverized (80 mesh) activated mill waste carbon based on the weight of the fiber was made using conventional paper making techniques. The paper was shredded to simulate tobacco and blended in amounts of 10%, 20%, 30%, 40%, and 50% by weight with tobacco and each blend made up into individual cigarettes. Identical control cigarettes were made containing 100% of the same kind of tobacco but not any of the shredded carbon paper. Samples of each of the cigarettes were smoked in a standard analytical smoking apparatus and the total particulate matter (TPM) yield measured from each sample for a total of approximately 10 puffs. The dry TPM yield for the control cigarettes was 33.26 mg whereas the dry TPM yield for the samples containing 10%, 20%, 30%, 40%, and 50% shredded carbon paper was 20.67 mg, 10.59 mg, 8.3 mg, 5.66 mg, and 3.7 mg, respectively. When measured, substantial reductions were also obtained in the organic vapor phase yields.

Samples of each of the cigarettes were then smoked for taste testing, and all of those containing blends of the shredded carbon paper were found to have an organoleptic effect substantially the same as the control cigarettes containing all tobacco.

EXAMPLE II

Various paper sheets were prepared in the manner of Example I containing 30% by weight cellulose flax fiber and 233% by weight filler based on the weight of fiber with the filler being varied as follows: 100% pulverized activated wood carbon, 133% calcium carbonate; 166% pulverized activated wood carbon, 67% calcium carbonate, all parts being by weight based on the weight of the cellulose fiber. The paper was shredded and blended with tobacco in amounts varying from 10% to 50% and each of the blends made into cigarettes. When smoked on a standard analytical testing apparatus for 10 puffs, each of the samples showed a marked decrease in TPM yields and organic vapor phase yields when compared to control cigarettes containing all tobacco and no shredded carbon filler paper. Taste testing by smoking revealed that the samples all had superior organoleptic properties and compared very favorably with cigarettes made from 100% tobacco.

EXAMPLE III

Paper sheets were prepared from cellulose flax fiber and a filler of 0%, 11%, 25%, 43%, 54%, 67%, 100%, 150%, and 233% pulverized activated wood carbon, respectively, all parts by weight based on the weight of the cellulose fiber. Each of the papers was shredded and blended with tobacco in the ratio of 15% shredded paper to 85% tobacco. The blends were then made up into cigarette samples and smoked. The acrolein/tar ratios measured from the smoke of each cigarette were as follows:

| Cigarette Sample | % Carbon Based on Weight of Cellulose in Paper | Acrolein/Tar Ratio |
|---|---|---|
| | 0% | $4.94 \times 10^{-3}$ |
| 2 | 11% | $4.78 \times 10^{-3}$ |
| 3 | 25% | $3.84 \times 10^{-3}$ |
| 4 | 43% | $3.27 \times 10^{-3}$ |
| 5 | 54% | $3.20 \times 10^{-3}$ |
| 6 | 67% | $3.15 \times 10^{-3}$ |
| 7 | 100% | $3.14 \times 10^{-3}$ |
| 8 | 150% | $2.83 \times 10^{-3}$ |
| 9 | 233% | $3.17 \times 10^{-3}$ |

The above data show that paper containing approximately 55% or more carbon by weight of cellulose fiber gives a balanced acrolein/tar smoke yield when blended with tobacco whereas with those papers containing less than 55% carbon the yield is unbalanced toward a high vapor phase, thus giving a more harsh smoke than a control sample of the same unsubstituted tobacco which yieled an acrolein/tar ratio of $3.18 \times 10^{-3}$. Moreover, very significant tar reductions are obtained with corresponding vapor phase reductions where at least 55% carbon filler is employed thus keeping the taste balanced.

As shown in the foregoing examples, the use of shredded carbon filled paper containing at least 55% carbon filler by weight of the cellulose fiber results in a tobacco substitute that produces substantial reductions in TPM and organic vapor phase yields in cigarettes and a balanced acrolein/tar ratio leaving the taste of the smoke relatively unaffected insofar as its organoleptic properties are concerned.

The foregoing examples and descriptions are illustrative of the invention only and it is to be understood that many variations may be resorted to without departing from the spirit or scope of the invention as those skilled in the art will readily understand.

What is claimed is:

1. A tobacco substitute characterized by the smoke produced therefrom having an acrolein/tar ratio of about $3.18 \times 10^{-3}$ and an organoleptic effect similar to natural tobacco smoke, and that when blended with tobacco and smoked reduces the total particulate matter and vapor phase yields to an extent greater than that expected from substitution of tobacco by an inert filler means in equivalent amounts, said substitute consisting of a shredded, combustible paper sheet of pulped natural organic cellulose fibers and finely pulverized carbon filler, said cellulose fibers constituting a sufficient amount of the weight of the sheet to enable sheet formation and handling during conventional paper making operations, said sheet containing at least 55% by weight carbon filler based on the weight of the cellulose fibers therein.

2. The tobacco substitute of claim 1 in which the paper sheet contains from 55% to 250% by weight carbon based upon the weight of the cellulose fibers.

3. The tobacco substitute of claim 1 in which the sheet contains an additional filler selected from the group consisting of an alkaline earth metal carbonate or oxide.

4. The tobacco substitute of claim 3 in which the additional filler is calcium carbonate.

5. A method of reducing the total particulate matter and vapor phase yields from tobacco smoke to an extent greater than that expected from substitution of tobacco by an inert filler means in equivalent amounts comprising intimately blending with the tobacco in a smoking article a tobacco substitute characterized by smoke produced therefrom having an acrolein/tar ratio of about $3.18 \times 10^{-3}$ and an organoleptic effect similar to natural tobacco smoke, said substitute consisting of a shredded, combustible paper sheet of pulped natural organic cellulose fibers and finely pulverized carbon filler, said cellulose fibers constituting a sufficient amount of the weight of the sheet to enable sheet formation and handling during conventional paper making operations, said sheet containing at least 55% by weight carbon filler based on the weight of the cellulose fibers therein.

6. The method of claim 5 in which said tobacco substitute contains from 55% to 250% by weight carbon based upon the weight of the cellulose fibers.

7. The method of claim 5 in which said tobacco substitute contains an additional filler selected from the group consisting of an alkaline earth metal carbonate or oxide.

8. The method of claim 7 in which the additional filler in said tobacco substitute is calcium carbonate.

9. A smoking article comprising a smoking charge of tobacco intimately blended with a tobacco substitute for reducing the total particulate matter and vapor phase yields in the smoke therefrom to an extent greater than that expected from substitution of tobacco by an inert filter means in equivalent amounts, said tobacco substitute characterized by the smoke produced having an acrolein/tar ratio of about $3.18 \times 10^{-3}$ and an organoleptic effect similar to natural tobacco smoke, said substitute consisting of a shredded, combustible paper sheet of pulped natural organic cellulose fibers and finely pulverized carbon filler, said cellulose fibers constituting a sufficient amount of the weight of the sheet to enable sheet formation and handling during conventional paper making operations, said sheet containing at least 55% by weight carbon filler based on the weight of the cellulose fibers therein.

10. The smoking article of claim 9 in which the tobacco substitute is blended with the tobacco in the smoking charge in an amount ranging from 10% to 50% by weight based on the weight of the smoking charge.

11. The smoking article of claim 9 in which said tobacco substitute contains from 55% to 250% by weight carbon based upon the weight of the cellulose fibers.

12. The smoking article of claim 9 in which the tobacco substitute contains an additional filler selected from the group consisting of an alkaline earth metal carbonate or oxide.

13. The smoking article of claim 12 in which said additional filler in said tobacco substitute is calcium carbonate.

* * * * *